US008253764B2

(12) United States Patent
Saito et al.

(10) Patent No.: US 8,253,764 B2
(45) Date of Patent: Aug. 28, 2012

(54) IMAGE FORMING APPARATUS

(75) Inventors: Yasuhide Saito, Saitama (JP); Yukinori Sezaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/095,327

(22) Filed: Apr. 27, 2011

(65) Prior Publication Data

US 2011/0200374 A1 Aug. 18, 2011

Related U.S. Application Data

(63) Continuation of application No. 11/642,539, filed on Dec. 21, 2006, now Pat. No. 7,956,879.

(30) Foreign Application Priority Data

Sep. 14, 2006 (JP) ..... 2006-249618

(51) Int. Cl.
*B41J 2/385* (2006.01)
*B41J 2/41* (2006.01)
*B41J 2/435* (2006.01)

(52) U.S. Cl. ..... 347/152; 347/138; 347/245; 347/263

(58) Field of Classification Search ..... None
See application file for complete search history.

(56) References Cited

U.S. PATENT DOCUMENTS

| | | | | |
|---|---|---|---|---|
| 6,144,468 | A | | 11/2000 | Watanabe |
| 7,050,204 | B1 | | 5/2006 | Sato et al. |
| 2006/0182476 | A1 | | 8/2006 | Imada et al. |
| 2006/0220309 | A1 | * | 10/2006 | Igarashi ..... 271/303 |

FOREIGN PATENT DOCUMENTS

| | | | | |
|---|---|---|---|---|
| JP | 05-197225 | A | | 8/1993 |
| JP | 05227372 | A | * | 9/1993 |
| JP | 6-135615 | A | | 5/1994 |
| JP | 2000-92275 | A | | 3/2000 |
| JP | 2000-258971 | A | | 9/2000 |
| JP | 2001-249599 | A | | 9/2001 |
| JP | 2004-184982 | A | | 7/2004 |
| JP | 2004-279691 | A | | 10/2004 |
| JP | 2005-309279 | A | | 11/2005 |

(Continued)

OTHER PUBLICATIONS

Japanese Office Action corresponding to Application No. 2006-249618, dated Nov. 30, 2010.

(Continued)

*Primary Examiner* — Matthew Luu
*Assistant Examiner* — Kendrick Liu
(74) *Attorney, Agent, or Firm* — Sughrue Mion, PLLC

(57) ABSTRACT

An image forming apparatus includes a main body frame; an image formation section contained in the main body frame that forms an image on a recording medium; an ejection mechanism contained in the main body frame that ejects the recording medium on which an image has been formed to an ejection section on the upper surface of the main body frame; an image scanning device mounted on the ejection section that scans the image of a document; and an operation section provided on the upstream side in the ejection direction of the recording medium in the ejection section that operates the image scanning device; wherein sides and the backside of the ejection section being opened viewed from the operation section side.

3 Claims, 9 Drawing Sheets

FOREIGN PATENT DOCUMENTS

JP 2006-159767 A 6/2006

OTHER PUBLICATIONS

United States Office Action corresponding to U.S. Appl. No. 11/642,539, dated Aug. 28, 2008.
United States Office Action corresponding to U.S. Appl. No. 11/642,539, dated Apr. 16, 2010.
Korean Office Action corresponding to Application No. 10-2007-0036005, dated Mar. 24, 2008.
United States Office Action corresponding to U.S. Appl. No. 11/642,539, dated Sep. 2, 2010.
United States Office Action corresponding to U.S. Appl. No. 11/642,539, dated Nov. 5, 2009.
United States Office Action corresponding to U.S. Appl. No. 11/642,539, dated Mar. 5, 2009.
Korean Notice of Allowance corresponding to Application No. 10-2007-0036005, dated Nov. 18, 2008.

* cited by examiner

IMAGE FORMING APPARATUS

CROSS-REFERENCE TO RELATED APPLICATIONS

This is a Continuation of application Ser. No. 11/642,539 filed Dec. 21, 2006, claiming priority based on Japanese Patent Application No. JP 2006-249618 filed Sep. 14, 2006, the contents of all of which are incorporated herein by reference in their entirety.

BACKGROUND OF THE INVENTION

1. Technical Field

The present invention relates to an image forming apparatus wherein an image scanning device is provided on the upper side of a main body frame; and a recording medium on which an image is formed is ejected from the side on which an operating section for operating the image scanning device is provided to the upper side of the main body frame.

2. Related Art

Heretofore, an image forming apparatus wherein a toner image formed on a photoreceptor (image carrier) or an intermediate transfer belt is transferred to/fixed on a recording paper (recording medium) to form an image has been known. In such image forming apparatuses, there is a type wherein an image scanning device for scanning an image from a document is provided on the upper side of the main body frame, or another type wherein a recording medium on which an image is formed is ejected from the side on which an operating panel (operation section) of an image scanning device is provided (user side) to a catch tray on the upper surface of the main body frame.

In an image forming apparatus wherein an operating section for operating the image scanning device is provided on the upstream side of an ejection direction of the recording medium, there are rooms for improvements in the workability in case of taking out a recording medium ejected on the upper surface of the main body frame, and the downsizing of the image forming apparatus.

SUMMARY

According to a first aspect of the present invention, an image forming apparatus may comprise a main body frame; an image formation section contained in the main body frame that forms an image on a recording medium; an ejection mechanism contained in the main body frame that ejects the recording medium on which an image has been formed to an ejection section on the upper surface of the main body frame; an image scanning device mounted on the ejection section that scans the image of a document; and an operation section provided on the upstream side in the ejection direction of the recording medium in the ejection section that operates the image scanning device; wherein lateral sides and the backside of the ejection section being opened viewed from the operation section side.

BRIEF DESCRIPTION OF THE DRAWINGS

Embodiments of the present invention will be described in detail based on the following figures, wherein.

DESCRIPTION

In the following, an exemplary embodiment of the present invention will be described based on examples illustrated in the accompanying drawings wherein letters "Y", "M", "C", and "K" of alphabet are optionally added to symbols representing parts relating to every colors of yellow (Y), magenta (M), cyan (C), and black (K), respectively.

Figure 1:
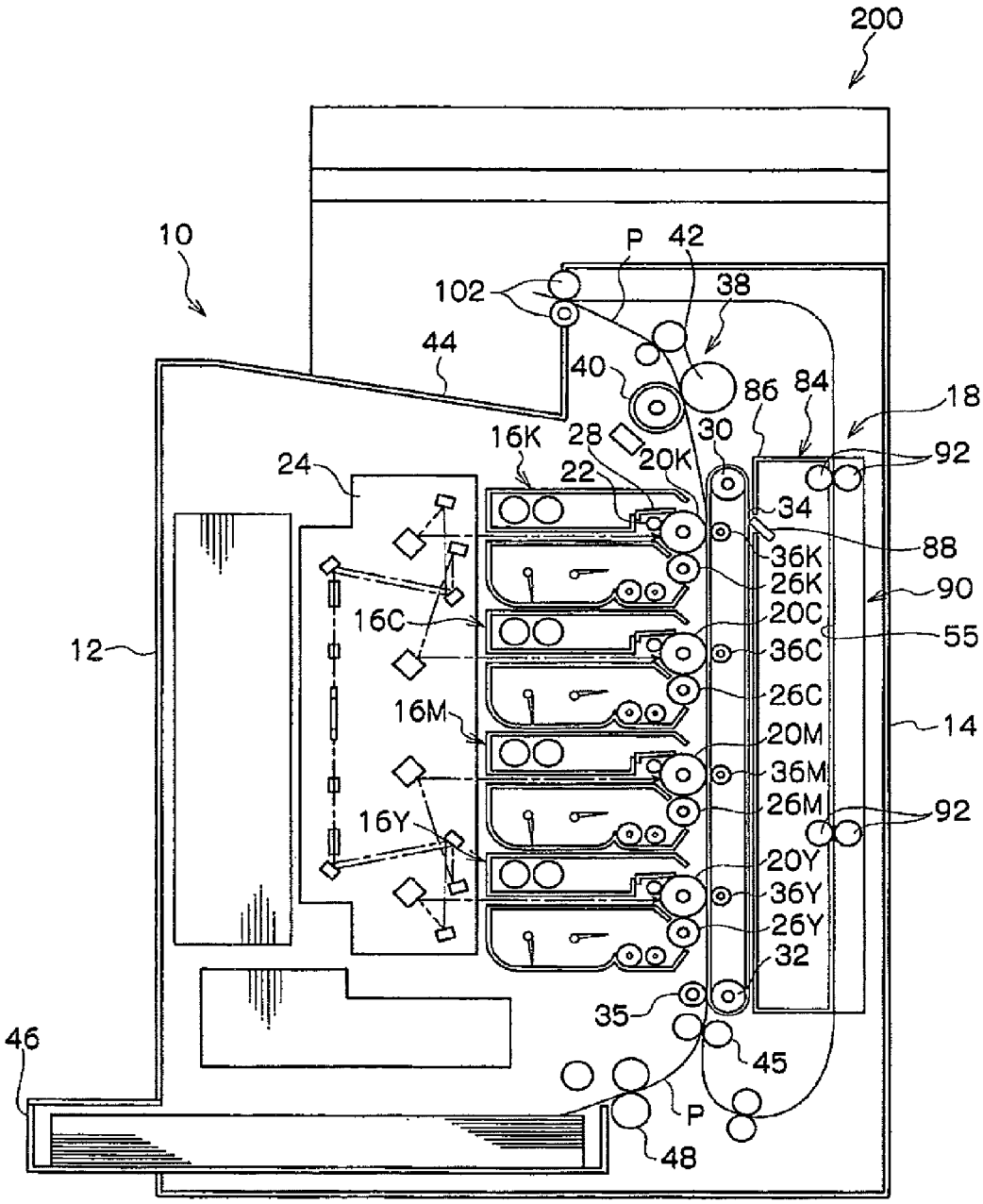
FIG. 1 is a schematic side view showing the constitution of the image forming apparatus according to a first exemplary embodiment of the invention.
Figure 2:
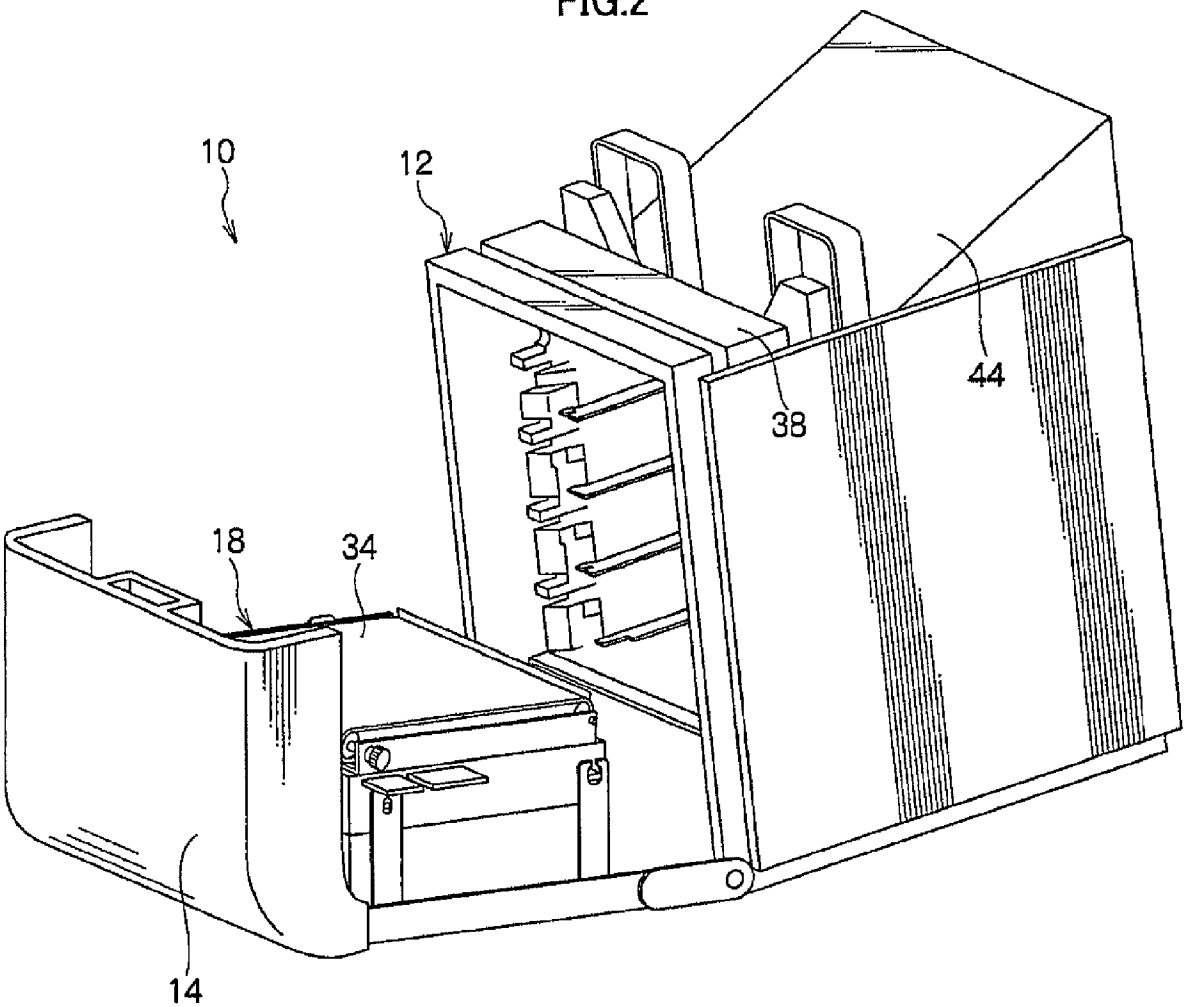
FIG. 2 is a perspective view showing the image forming apparatus of FIG. 1.

First, the outline of an image forming apparatus 10 according to an exemplary embodiment of the invention will be described. As shown in FIGS. 1 and 2, the image forming apparatus 10 includes a main body frame 12 containing detachably an image carrier (photoreceptor) 20 and a development unit 16, and a cover body 14 for opening and closing the image carrier 20 and the development unit 16, besides a fixing device 38 which will be mentioned later. A conveyor unit 18 provided with a conveyor belt 34 or the like is detachably attached to the cover body 14. The cover body 14 is composed of a front cover section 14A for opening and closing the top of the apparatus and an upper cover section 14B for opening and closing the top of the apparatus; and the cover body 14 has an L-shaped contour section viewed from the side thereof.

The development unit 16 is provided with charging rollers 22 for uniformly charging the surface of the roller-shaped image carrier 20, an optical box 24 for irradiating an image light to the image carrier 20 based on image data to form a latent image due to the electrostatic potential difference, development rollers 26 for transferring selectively toners to the latent image to visualize the image, and a cleaning member 28 being in contact slidably with the image carrier 20 being in a state after the toner image is transferred to clean the toners remained on the image carrier 20.

The image carrier 20 has a photoreceptor layer on the surface (circumference) thereof, the surface (circumference) is uniformly charged with the charging rollers 22, and then, the surface (circumference) is exposed with a laser beam (image light) irradiated from the optical box 24. When an electric potential of the expose part attenuates, the electrostatic latent image (picture image) is formed on the photoreceptor layer. The charging rollers 22 abut against the image carrier 20, whereby a voltage is applied between them to produce electric discharge in very small spaces in the vicinities of the abutting area, so that the surface (circumference) of the image carrier 20 is charged substantially uniformly.

The optical box 24 scans the surface (circumference) of the image carrier 20 with a flashing laser beam, whereby an electrostatic latent image is formed on the surface (circumference) of the image carrier 20 based on the image data. As the optical box 24, it may be considered to be the one wherein light emitting devices such as LEDs and the like are disposed, and they are flashed based on the image data.

The development rollers 26 are placed in such that they are closely opposed to the image carrier 20; and a development bias voltage is applied between the development rollers 26 and the image carrier 20. As a result, a development bias electric field is established between the development rollers 26 and the image carrier 20, whereby the toners having electric charge sifts to the parts exposed on the image carrier 20 to form a visual image.

On the other hand, the conveyor unit 18 is provided with at least a conveyor belt 34 stretched between a driving roller 30 and a driven roller 32. On the inner surface side of the conveyor belt 34, a plurality of transfer rollers 36 (four transfer rollers in the example, the positions of which correspond to the respective colors described hereinafter) disposed with each prescribed spacing at each of the prescribed positions extending from the driving roller 30 to the driven roller 32.

The transfer roller 36 is adapted to oppose to the image carrier 20 sandwiching the conveyor belt 34 in between them, when the cover body 14 is closed (when the cover body 14 is rotated to the side of the main body frame 12 for closing the image carrier 20 or the like), whereby a transfer electric field is formed between the conveyor belt 34 and the image carrier 20, so that a toner image (an unfixed image) on the surface of the image carrier 20 is transferred to the recording paper P passing through in an adsorbed state on the conveyor belt 34.

The conveyor unit 18 is provided with a charging roller 35 opposed to the driven roller 32 sandwiching a transfer path for the recording paper P. The charging roller 35 holds the recording paper P and the conveyor belt 34 together with the driven roller 32 in a sandwiched manner between the both rollers, and further charges the recording paper P to be adsorbed electrostatically on the adsorption and conveyance surface of the conveyor belt 34.

The conveyor unit 18 is provided with a cleaning section 84 for cleaning the conveyor belt 34. The cleaning section 84 is provided with a collection box 86 disposed between the conveyor belt 34 and the cover body 14, and a blade 88 supported by the collection box 86 and the extreme end thereof is allowed to abut against the conveyor belt 34. In the cleaning section 84, the blade 88 scrapes off the toners or the paper dusts adhered to the conveyor belt 34, and the collection box 86 collects the toners or the paper dusts thus scraped off therein.

Furthermore, the conveyor unit 18 is provided with a reversible conveyor section 90 for reversing the recording paper P on the surface of which has been printed and conveying the reversed recording paper P on the adsorption and conveyance surface of the conveyor belt 34. The reversible conveyor section 90 is provided with a plurality of conveyor roller pairs 92 arranged along the vertical direction between the conveyor belt 34 and the cover body 14, and a guide plate 55 for guiding the recording paper P conveyed by the conveyor roller pairs 92.

Each of the development units 16 is disposed so as to be capable of full color printing in such that from the bottom of the apparatus, for example, a yellow (Y) development unit, a magenta (M) development unit, a cyan (C) development unit, and a black (K) development unit, in this order, along the vertical direction of the apparatus; and the fixing device 38 is positioned on the downstream side of the conveyance direction of the recording paper P with respect to the positions of these development units 16Y to 16K (in other words, the upper portion of the main body frame 12).

The fixing device 38 is provided with a heating roller 40 and a pressure roller 42, the circumferences of them being opposed to each other and pressing (nipping) the circumferences into contact with each other with a prescribed pressure. When an unfixed toner image transferred to the recording paper P is heated and pressed by the heating roller 40 and the pressure roller 42, a toner image is fixed on the recording paper P.

The recording paper P on which the toner image is fixed as a result of heating and pressing the unfixed toner image by the fixing device 38 (the heating roller 40 and the pressure roller 42) is ejected by a ejection roller 102 on the catch tray 44. After completing transfer of the toner image to the recording paper P, the surface (circumference) of the image carrier 20 is cleaned with the cleaning member 28 to stand ready for the following image formation treatment.

A detachable feed cassette 46 is provided on the lower part of the main body frame 12. The feed cassette 46 is arranged to be capable of drawing in the opposite direction with respect to the direction along which the recording papers are delivered, so that the recording papers may be arbitrarily fed.

In the vicinity of the extreme end portion of the feed cassette 46, a feed roller pair 48 for delivering a recording paper P one by one from the feed cassette 46 is disposed. The recording paper P delivered from the feed roller pair 48 is sent to the adsorption and conveyance surface of the conveyor belt 34 by a resist roller pair 45 at a prescribed timing and conveyed to a position at which a toner image is to be transferred in respective colors.

Figure 3:
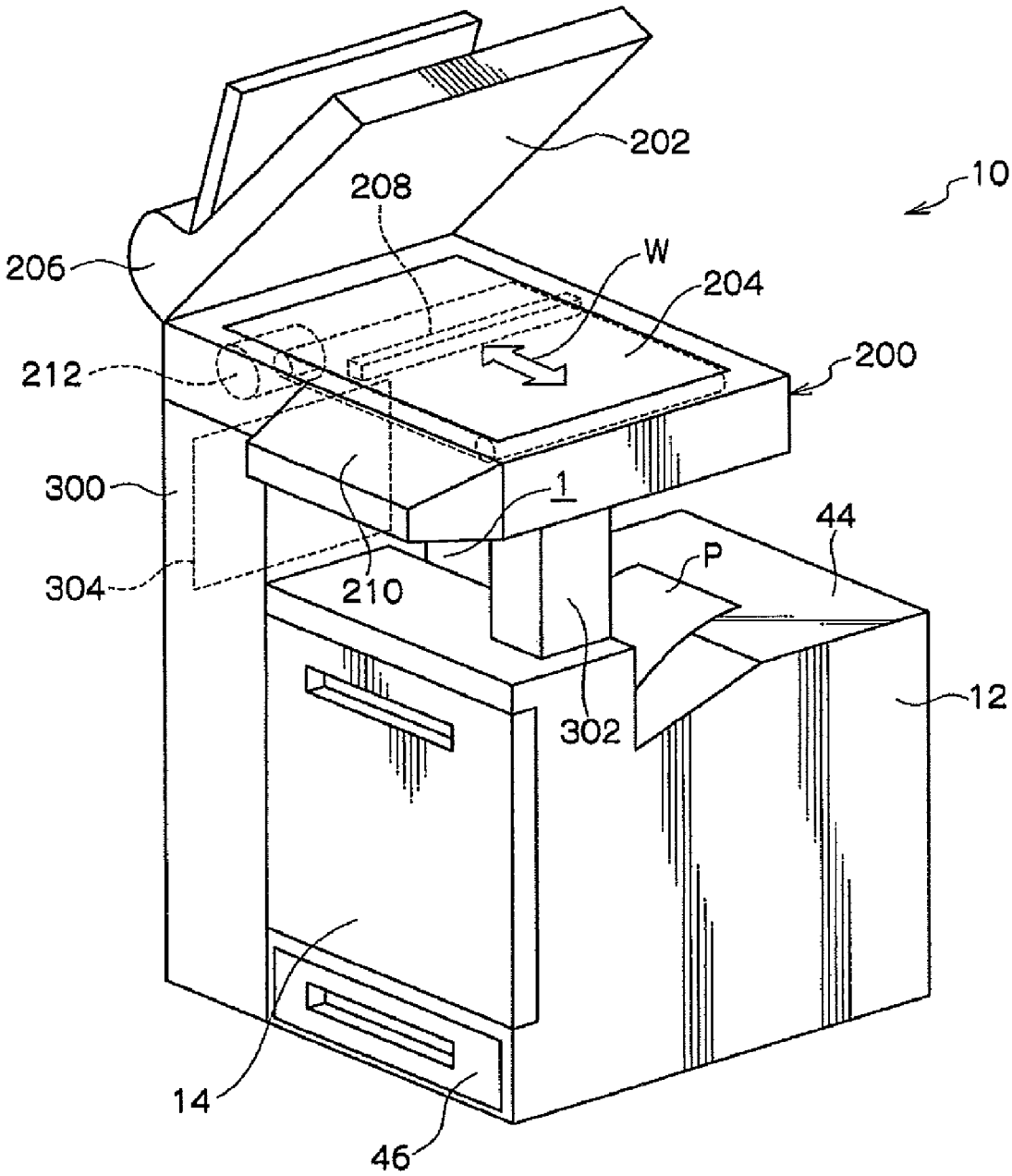
FIG. 3 is a perspective view showing the image forming apparatus of FIG. 1.

Moreover, an image scanning device 200 is disposed on the upper part of the main body frame 12. As shown in FIG. 3, the image scanning device 200 has a substantially square shape, when it is viewed flatways; and it is mounted on a first support post section 300 and a second support The first support post section 300 and the second support post section 302 extend at the right and left side with respect to the apparatus when viewed from the front side (the user side) of the apparatus. Inside the first support post section 300, electric components 304 such as a power source board, and a control board are disposed, whereby the space inside the first support post section 300 is effectively utilized.

The image scanning device 200 is provided with a presser plate 202, a platen 204, an automatic document feeder 206, a scanning bar 208, and an operation section 210 wherein the presser platen 202 is attached rotatably to the upper part of the image scanning device 200, and the platen 204 is disposed under the presser platen 202 and which is composed of a transparent platen glass or the like on the upper surface of which a document is mounted on. The automatic document feeder 206 is mounted on the presser platen 202, and the scanning bar 208 is disposed under the platen 204 and which is composed of a CCD or the like for scanning the document mounted on the platen 204. The operation section 210 is placed on the side front of the image scanning device 200, while the scanning bar 208 extends elongatedly from the front side to the backside of apparatus. The scanning bar 208 is scanned in the direction of the arrow W by a scanner driving mechanism 212 to scan the image on the document mounted on the platen 204. Furthermore, an operation keys are provided on the top of the operation section 210; and when these operation keys are operated, scanning of the document by the image scanning device 200 is started and stopped.

In the image forming apparatus 10 of the embodiment, a recording paper P is conveyed from the operation section 210 side (the front side or the user side) in the vertical direction (the perpendicular direction) and ejected to the side opposite to the operation section 210 (the backside of the apparatus) on the catch tray 44. The catch tray 44 is positioned directly below the image scanning device 200, and the front side of the main body frame 12 protrudes upwards from the level of the catch tray 44. Accordingly, if the space defined between the main body frame 12 and the image scanning device 200 is obstructed by any portion of the apparatus on the upstream side in the ejection direction of the recording paper P as in a conventional image forming apparatus, a user cannot watch the area above the catch tray 44, so that a position of the recording paper P ejected on the catch tray 44 cannot be confirmed, resulting in poor workability.

On the other hand, in the image forming apparatus 10 of the embodiment, since the image scanning device 200 is mounted on the first support post section 300 and the second support post section 302 which are established vertically on the main body frame 12, a space 1 is kept between the image scanning device 200 and the main body frame 12. In addition, the first support post section 300 is provided at the end of the left side on the main body frame 12 viewed from the operation section side 210 (the user side) (hereinafter referred to as "the left side"), while the second support post section 302 is provided at the end of the right side on the main body frame 12 viewed from the user side (hereinafter referred to as "the right side"), whereby the space 1 is kept widely, so that the user can watch the place extending over the catch tray 44 through the space 1 and may take out the recording paper P ejected on the catch tray 44, resulting in good workability.

In the image forming apparatus 10 of the embodiment, the cover body 14 for opening and closing the inside of the main body frame 12 is provided on the same side as that of the operation section 210 of the image scanning device 200. Thus, the unit housed in the main body frame 12 may be maintained or exchanged from the same direction as that of the cover body 14; and the image scanning device 200 can be operated in also the same direction as that of the cover body 14, whereby good workability is obtained.

An opening for drawing the feed cassette 46 from the main body frame 12 is disposed on the same side as that of the operation section 210, so that operations for drawing the feed cassette 46 from and pressing into the port may be carried out in the same direction as that for operating the image scanning device 200, resulting in good workability.

The backside of the catch tray 44 is opened viewed from the side of the operation section 210 (the user side), so that the depth of the catch tray 44 can be reduced more than the maximum length of the recording paper P to be used. As a result, the depth of the apparatus may be shortened as compared with the case where the backside of the catch tray 44 is not opened. In even the case where the depth of the catch tray 44 is made to be equal to or less than the maximum length of the recording paper P to be applied, the recording paper can be taken out, while the recording paper P is removed in the direction not only right beside but also the backside and the operation section side 210 by an operator who stands at the operation section side 210, resulting in good workability.

Next, a second exemplary embodiment of the invention will be described wherein the same constitutions as that of the first embodiment are designated by the same reference numerals as those of the first embodiment, and the explanation therefor will be omitted.

Figure 4:
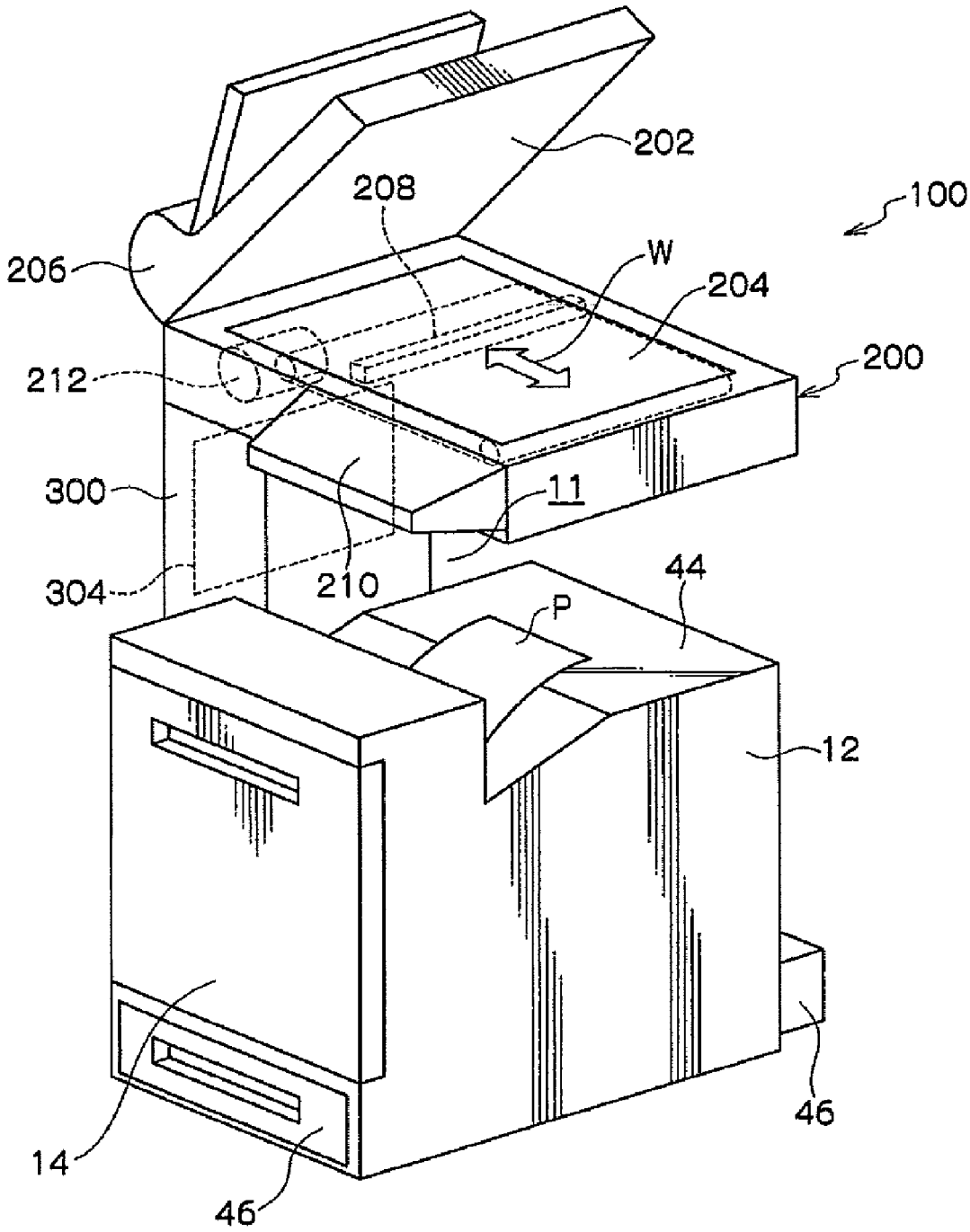
FIG. 4 is a perspective view showing the image forming apparatus according to a second exemplary embodiment of the invention.

As shown in FIG. 4, in an image forming apparatus 100 according to the embodiment, a first support post section 300 is established vertically on the left side of a main body frame 12 at the end thereof when the apparatus is viewed from the front side; and an image scanning device 200 is mounted on the first support post section 300. Inside the first support post section 300, electric components 304 such as a power source board, and a control board are disposed, whereby the space inside the first support post section 300 is effectively utilized.

Since the image scanning device 200 is mounted on the first support post section 300 established vertically on the main body frame 12, a space 11 is defined between the image scanning device 200 and the main body frame 12; and further, since the first support post section 300 is provided on the user side of the main body frame 12 at the left end thereof, the space 11 may be wider than that of the first embodiment. Thus, the area, which may be observed by the user, becomes wider as compared with the case of the first embodiment, when the user watches the place on the catch tray 44 through the space 11. As a result, the user can more easily take out the recording paper P ejected on the catch tray 44.

In the embodiment, it is further arranged in such that the operation section 210 does not protrude towards the user side over the end position of the main body frame 12 with respect to the position of the user. Moreover, the bottom of the operation section 210 is provided on the upper side than that of the image scanning device. For this reason, when the user watches the place on the catch tray 44 from the obliquely upward direction through the space 11, the area, which can be observed by a user, becomes wide, resulting in good workability.

In the embodiment, the backside of a feed cassette 46 protrudes from the backside of the main body frame 12, so that the space for installing the image forming apparatus 100 expands by an amount due to the above-described arrangement, but the end portion of the backside of the image scanning device 200 is positioned above the expanded space. In other words, the image scanning device 200 is retracted towards the backside of the apparatus by an amount corresponding to the expanded space towards the backside which is defined with the feed cassette 46, whereby the area which can be observed by a user becomes further wider, when the user watches the place on the catch tray 44 from the obliquely upper direction through the space 11, resulting in good workability. In the embodiment, although the end portion on the backside of the image scanning device 200 is provided at the position where is closer to the backside of the apparatus 100 than that of the main body frame 12 and the position closer to the user side than the end portion on the backside of the feed cassette 46, the end portion on the backside of the image scanning device 200 may be made to be flat with the end portion on the backside of the feed cassette 46.

In the meantime, the home position (the standby position) of a scanning bar 200 is set out on the left side of the image scanning device 200, and an automatic document feeder 206 is also provided on the left side of the image scanning device 200, so that the center of gravity is unbalanced to the left side of the image scanning device 200. In these circumstances, the end portion on the left side of the image scanning device 200 wherein the center of gravity thereof deviates is supported by the first support post 300 in the embodiment, whereby the bending moment added to the first support post 300 is reduced to suppress an inclination along the right and left directions of the image scanning device 200. As a result, decrease in the performance for scanning the image of a document by the image scanning device 200 is suppressed.

Since greater part of users is right-handed user, workability of the most of users is improved as a result of opening the right side of the image formation apparatus.

Next, a third embodiment of the invention will be described wherein the same constitutions as that of the first and second embodiments are designated by the same reference numerals as those of the first and second embodiments, and the explanation therefor will be omitted.

Figure 5:
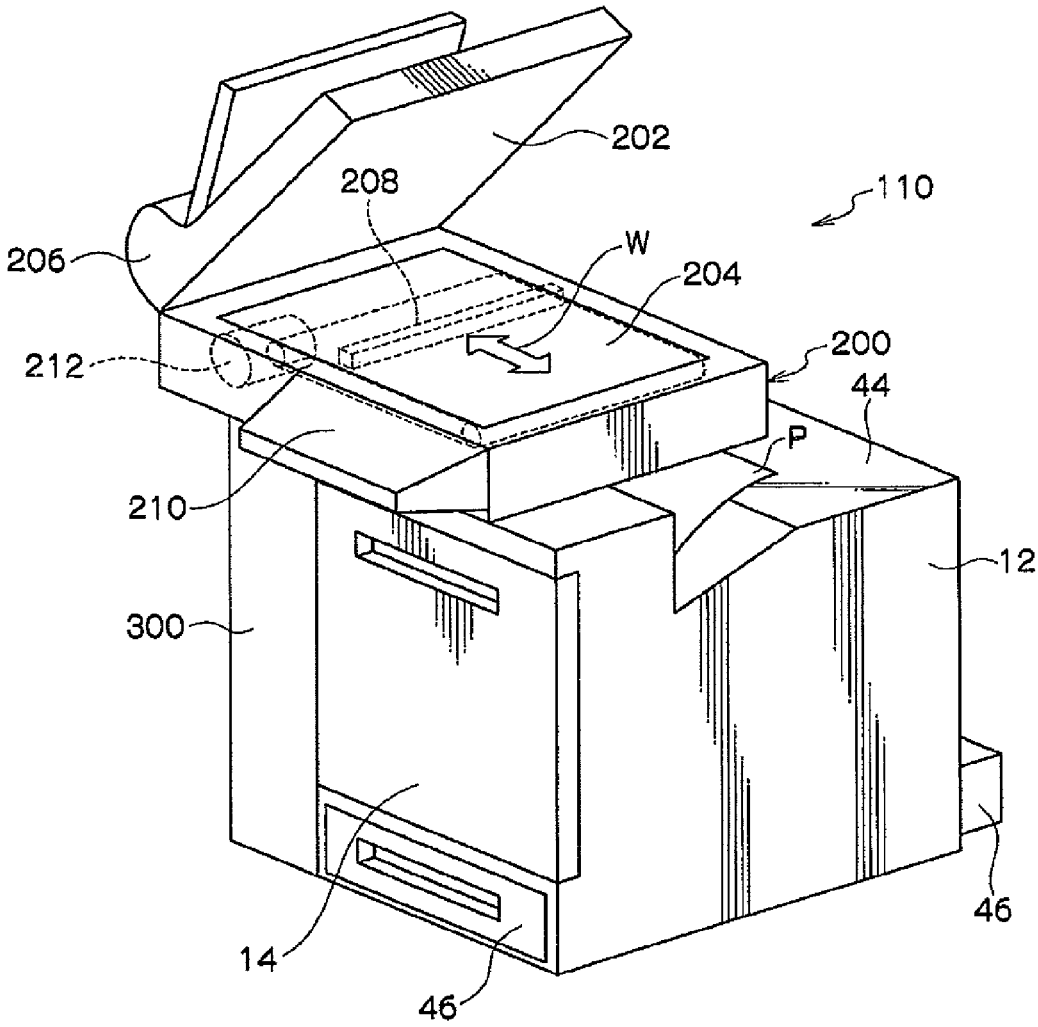
FIG. 5 is a perspective view showing the image forming apparatus according to a third exemplary embodiment of the invention.

As shown in FIG. 5, in an image forming apparatus 110 according to the embodiment, an image scanning device 200 is directly mounted on a main body frame 12. The image scanning device 200 is arranged in such that the end portion on the right side of the image scanning device 200 is provided to be closer to the left side than the end portion on the right side of a main body frame 12, whereby the place on a catch tray 44 can be observed from the right side of the image scanning device 200.

Figure 6:
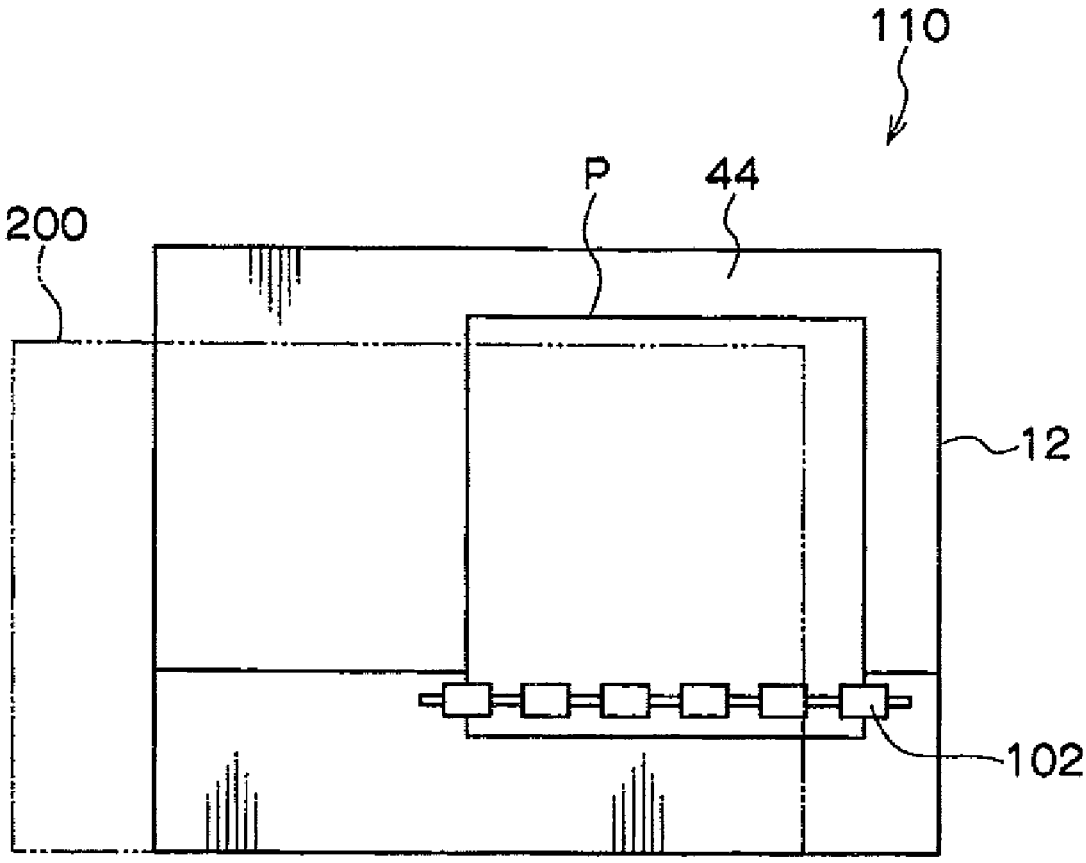
FIG. 6 is a plan view showing the image forming apparatus of FIG. 5.

In the image forming apparatus 110 of the embodiment, a recording paper P is conveyed to paper ejection rollers 102 in a condition wherein the recording paper P is approached to the right side of the main body frame 12, and the recording paper P is ejected on the catch tray 44 by means of the paper ejection rollers 102 which is provided in the right side approached condition as shown in FIG. 6.

Since the end portion on the right side of the image scanning device 200 is adapted to position closer to the left side of the main body frame 12 than the end portion on the right side of the recording paper P ejected on the catch tray 44, any of the recording papers P having all the sizes ejected on the catch tray 44 can be observed from the right side of the image formation device 200.

Next, a fourth embodiment of the invention will be described wherein the same constitutions as that of the first to the third embodiments are designated by the same reference numerals as those of the first to the third embodiments, and the explanation therefor will be omitted.

Figure 7:
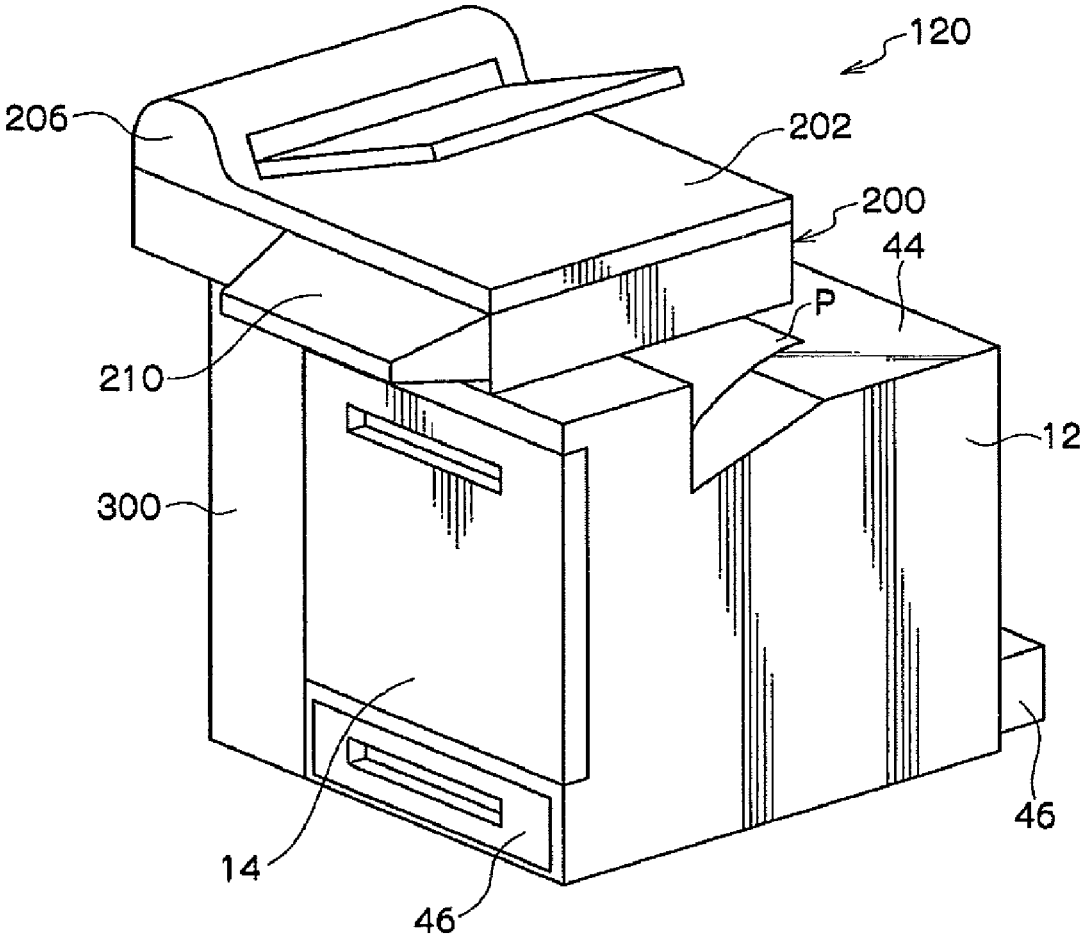
FIG. 7 is a perspective view showing the image forming apparatus according to a fourth exemplary embodiment of the invention.

As shown in FIG. 7, in an image forming apparatus 120 according to the embodiment, an image scanning device 200 is directly mounted on a main body frame 12. The image scanning device 200 is arranged in such that the end portion on the right side of the image scanning device 200 is provided to be closer to the left side than the end portion on the right side of a main body frame 12, whereby the place on a catch tray 44 can be observed from the right side of the image scanning device 200.

Figure 8A:
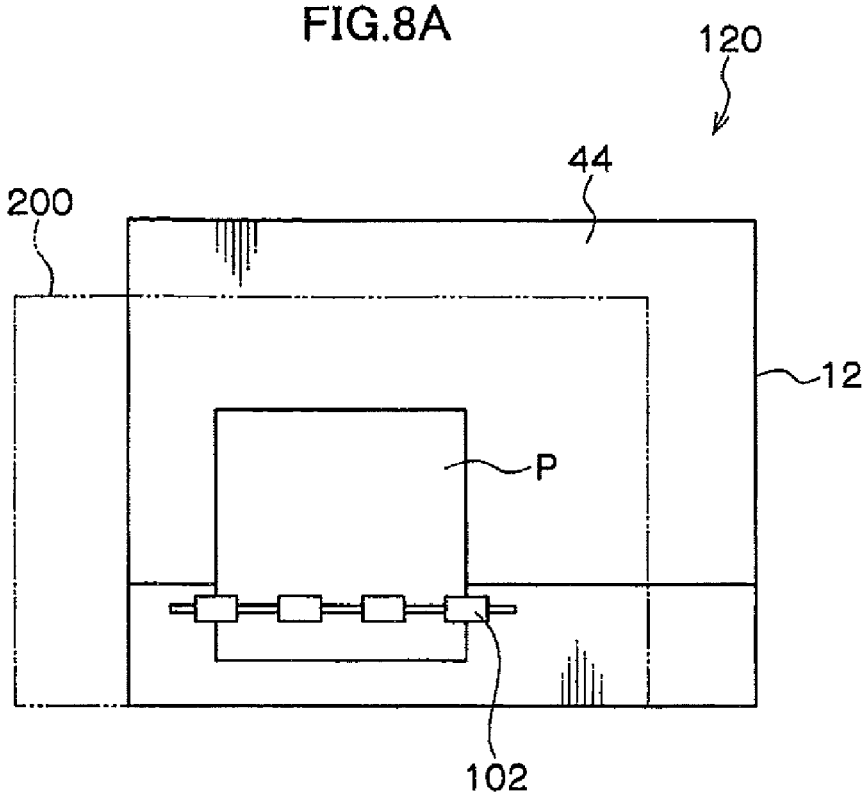
FIGS. 8A and 8B are plan views each showing the image forming apparatus of FIG. 7.
Figure 8B:
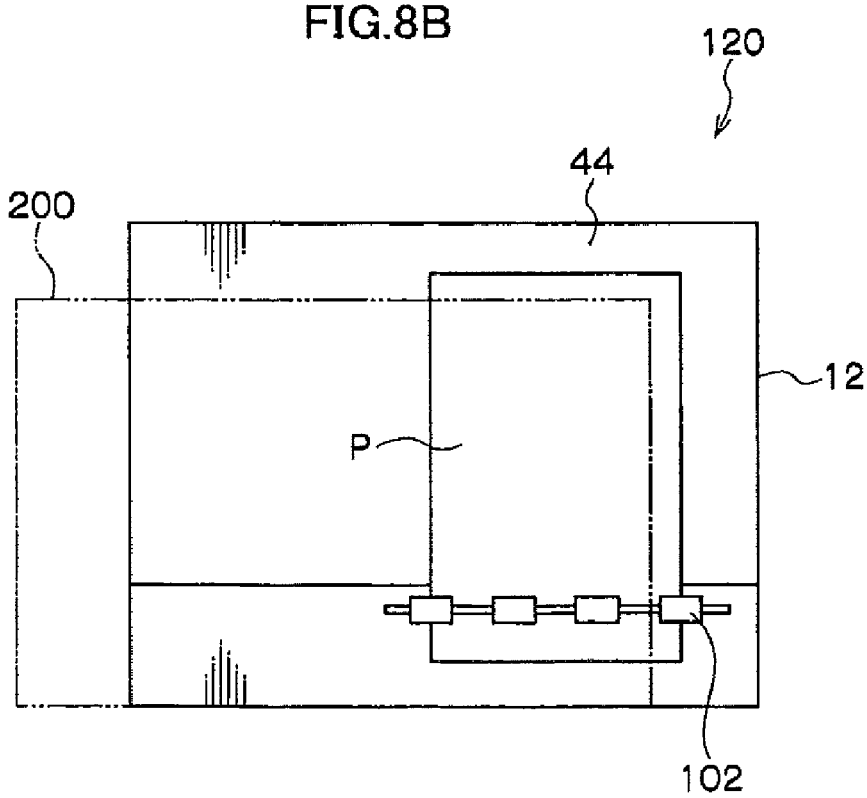

Additionally, as shown in FIGS. 8A and 8B, the image forming apparatus 120 is provided with a mechanism (not shown) for shifting axially paper ejection rollers 102, whereby the paper ejection rollers 102 are shifted to the right side on the way to conveying the recording paper P held therebetween. Hence, the recording paper P is conveyed to the paper ejection rollers 102, thereafter shifted to the right side, and ejected on the catch tray 44.

The end portion on the right side of the image scanning device 200 is adapted to position closer to the right side than the end portion of the right side of a recording paper P having the minimum size and going straight up to the paper ejection rollers 102, and on the other hand, the end portion on the right side of the image formation device 200 is adapted to position closer to the left side than the end portion of the right side of the recording paper P having the minimum size and shifted to the right side by means of the paper ejection rollers 102.

Namely, the recording paper P is shifted to the area on the catch tray 44 by means of the paper ejection rollers 102 which can be observed by a user.

In the first to the fourth embodiments, although the first support post section 300 and the second support section 302 are provided at the opposite end sides in the direction perpendicular to the ejection direction of the recording paper P, the invention is not restricted thereto, but any position may be applied as long as the catch tray 44 can be observed from the operation section side 210, and it may be even the downstream side of the ejection direction of the recording paper P.

In the fourth embodiment, the recording paper P on the catch tray 44 can be observed from the operation section side, so that a working operation for taking out the recording paper P on the catch tray 44 is very easy. However, even if the recording paper P itself cannot be observed from the side of operation section 210, it may be judged that the recording paper P is positioned in the area on the catch tray 44 as long as the catch tray 44 may be watched from the operation section side 210. Accordingly, it is not indispensable in the invention that the recording paper P on the catch tray 44 can be observed from the operation section side 210, but it is sufficient for confirming the position of the recording paper P by only observing the catch tray 44 from the operation section side 210.

Next, a fifth embodiment of the invention will be described wherein the same constitutions as that of the first to the fourth embodiments are designated by the same reference numerals as those of the first to the fourth embodiments, and the explanation therefor will be omitted.

Figure 9:
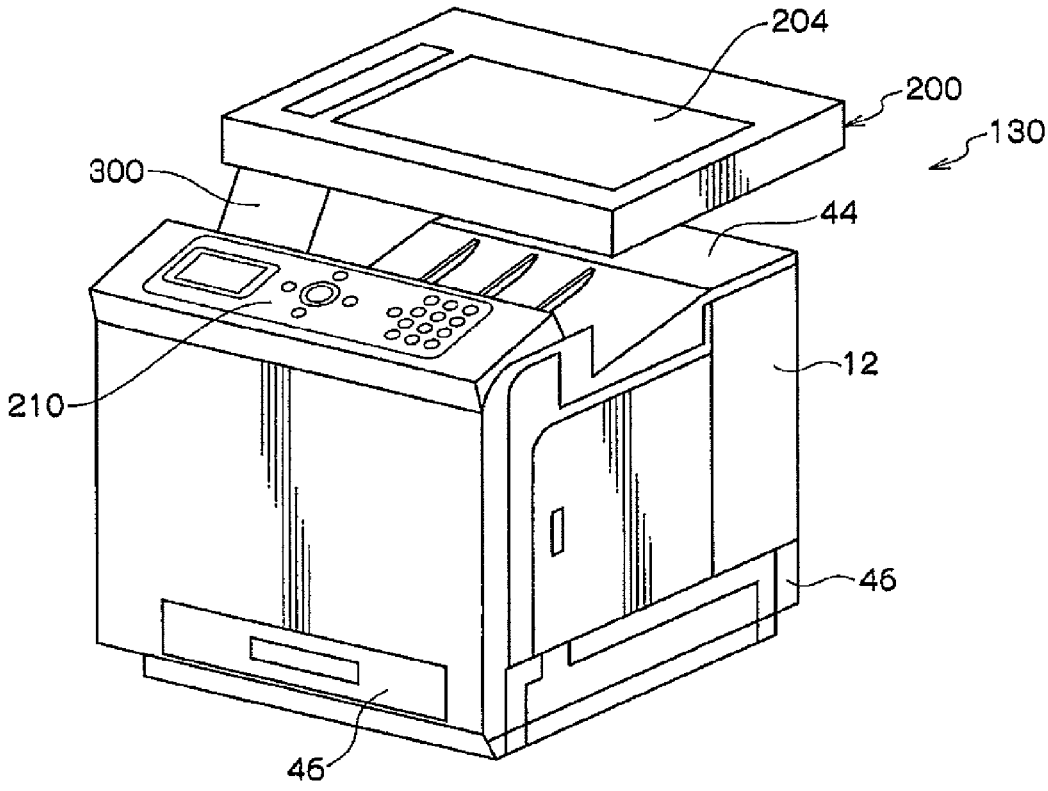
FIG. 9 is a perspective view showing the image forming apparatus according to a fifth exemplary embodiment of the invention.

As shown in FIG. 9, in an image forming apparatus 130 according to the embodiment, an operation section 210 is mounted on a main body frame 12. The image forming apparatus 130 is arranged in such that sides and the backside of a catch tray 44 are opened viewed from the operation section side 210, whereby the depth of the catch tray 44 may be more reduced than the maximum length of a recording paper P to be applied, so that the depth of the image forming apparatus 130 may be reduced as compared with the case where the backside of the catch tray 44 is not opened. Thus, the depth of the apparatus may be shortened as compared with the case where the backside of the catch tray 44 is not opened. In even the case where the depth of the catch tray 44 is made to be equal to or less than the maximum length of the recording paper P to be applied, the recording paper on the catch tray 44 can be taken out while the recording paper P is removed in the direction not only right beside, but also the backside and the operation section side 210 by an operator who stands at the operation section side 210, resulting in good workability.

In the first to the fifth embodiments, although the invention has been described by taking an electrophotographic system image forming apparatus as an example, the invention is also applicable for the other systems such as ink jet recording system.

According to a first aspect of the present invention, an image forming apparatus may comprise a main body frame; an image formation section that is contained in the main body frame and forms an image on a recording medium; an ejection mechanism that is contained in the main body frame and ejects the recording medium on which an image has been formed by the image formation section to an ejection section on the upper surface of the main body frame; an image scanning device that is mounted on the ejection section and scans an image of a document; and an operation section that is provided on the upstream side, in the ejection direction of the recording medium, of the ejection section and operates the image scanning device, wherein sides and a backside of the ejection section are open when viewed from the operation section side.

In accordance with the above-described aspect, the recording medium is ejected on the upper surface of the main body frame by the ejection section after an image was formed on the recording medium by the image formation section in the main body frame. On the other hand, an image of a document is scanned by the image scanning device mounted on the upper part of the ejection section of the main body frame.

The operation section that operates the image scanning device is provided on the upstream side, in the ejection direction of the recording medium, of the ejection section, and the sides of the ejection section are open when viewed from the operation section side. As a result, a user standing on the operation section side may take out the recording medium ejected on the ejection section by removing laterally the recording medium.

Since the backside of the ejection section is open when viewed from the operation section side, the depth of the ejection section can be reduced more than the maximum length of the recording medium to be used. As a result, the depth of the apparatus may be shortened as compared with the case where the backside of the ejection section is not open. In even the case where the depth of the ejection section is made to be equal to or less than the maximum length of the recording medium to be applied, the recording medium can be taken out while the recording medium is removed in the direction not only right beside, but also the backside by a user standing at the operation section side, resulting in good workability.

The above-described aspect may comprise further a supporting section that supports the image scanning device onto the main body frame so as to define a space between the image scanning device and the main body frame on the upstream side in the ejection direction of the recording medium.

According to the above-described aspect, since the image scanning device is supported with the main body frame by the supporting section so as to define the space between the image scanning device and the main body frame on the upstream side in the ejection direction of the recording medium, a user standing on the operation section side can watch the upper surface of the main body frame through the space, whereby a position of the recording medium ejected on the upper surface of the main body frame can be confirmed. Thus, the working operation for taking out the recording medium ejected on the upper surface of the main body frame becomes easy.

In the above-described aspect, the ejection direction of the recording medium may be in a substantially horizontal direction; the direction perpendicular to the ejection direction in the horizontal direction may be defined as a first direction; the end side of the image forming apparatus in the first direction may be defined as a first end; and the other end side in the first direction may be defined as a second end.

According to the above-described aspect, the image scanning device is supported with the main body frame by the first supporting section provided on the end side in the first direction being in that perpendicular to the ejection direction of the recording medium in the main body frame, whereby a space is defined between the main body frame and the image scanning device on the upstream side in the ejection direction of the recording medium and on the second end side in the first direction, so that a user standing on the operation section side can watch the upper surface of the main body frame through the space.

In the above-described aspect, the center of gravity of the image scanning device is provided at the first end side.

According to the above-described aspect, since the first supporting section supports the first end side in the first direction of the image scanning device, the bending moment due to the weight of the image scanning device is added to the first supporting section. However, since the center of gravity of the image scanning device is positioned on the first end side in the first direction, the bending moment to be applied to the first supporting section is reduced, whereby an inclination of the image scanning device can be suppressed and a decrease in the scanning performance of the image of a document in the image scanning device can be suppressed.

In the above-described aspect, the supporting section may have a second supporting section provided on the second end side in the first direction of the image forming apparatus.

According to the above-described aspect, the image scanning device is supported with the main body frame by the first supporting section provided on the first end side in the first direction and the second supporting section provided on the second end side in the main body frame. As a result, a space is formed between the main body frame and the image scanning device on the upstream side of the ejection direction of the recording medium and in the central part of the first direction, whereby a user standing on the operation section side can watch the upper surface of the main body frame through the space.

Furthermore, the opposite end sides in the first direction of the image scanning device are supported by the first and the second supporting sections, whereby bending moments applied to the first and second supporting sections can be reduced, so that an inclination of the image scanning device may be suppressed and thereby decrease in scanning performance of the image of a document in the image scanning device can be suppressed.

In the above-described aspect, the end of the operation section on the upstream side in the ejection direction of the recording medium is provided at a position above the main body frame.

In the above-described aspect, the end of the operation section on the upstream side in the ejection direction of the recording medium may be provided at a position above the main body frame. Namely, since the operation section does not protrude towards the user standing side on the operation section side, the area wherein the upper surface of the main body frame which can be observed by a user becomes wide, when the user watches the upper surface of the main body frame from an obliquely upper position through the space defined between the main body frame and the image scanning device. As a result, a position of the recording medium ejected on the upper surface of the main body frame becomes easily confirmed, resulting in an easy operation for taking out the recording medium.

In the above-described aspect, the main body frame may be provided with a member protruding horizontally from an end position thereof at the downstream side in the ejection direction of the recording medium; and the end of the image scanning device on the downstream side in the ejection direction of the recording medium may be provided at a position above the member.

According to the above-described aspect, there is the member protruding in the horizontal direction from the end of the main body frame on the downstream side in the ejection direction of the recording medium, and the end of the image scanning device on the downstream side in the ejection direction of the recording medium is provided at a position above the member.

Thus, the installation space of the image forming apparatus is widen by the protrusion amount of the member, and the image scanning device is provided by moving it towards the downstream side in the ejection direction of the recording medium within a range of the widen installation space. In this arrangement, since the operation section is retracted from the user standing side on the operation section side, the area wherein the upper surface of the main body frame which can be observed by the user becomes wide, when the user watches the upper surface of the main body frame from an obliquely upper position through the space defined between the main body frame and the image scanning device. As a result, a position of the recording medium ejected on the upper surface of the main body frame becomes easily confirmed, resulting in an easy operation for taking out the recording medium.

In the above-described aspect, the bottom of the operation section may be provided at a higher position than the bottom of the image scanning device.

According to the above-described aspect, the bottom of the operation section is provided at a higher position than the bottom of the image scanning device. Hence, the area wherein the upper surface of the main body frame which can be observed by a user becomes wide, when the user watches the upper surface of the main body frame from an obliquely upper position through the space defined between the main body frame and the image scanning device. As a result, a position of the recording medium ejected on the upper surface of the main body frame becomes easily confirmed, resulting in an easy operation for taking out the recording medium.

In the above-described aspect, the image scanning device may be provided close to the first end in the first direction.

According to the aspect, the image scanning device is provided closer to the first end than the other end of the first direction of the main body frame, whereby a user standing on the operation section side can watch the upper surface of the main body frame from the second end side in the first direction of the image scanning device. As a result, the recording medium ejected on the upper surface of the main body frame can be confirmed, resulting in an easy operation for taking out the recording medium.

In the above-described aspect, the second end side of the image scanning device in the first direction may be provided closer to the first end side in the first direction than the second end side of the recording medium ejected on the upper surface of the main body frame in the first direction.

According to the aspect, a user standing on the operation section side can watch the recording medium ejected on the upper surface of the main body frame from the second end side in the first direction of the image scanning device. As a result, the user can catch the recording medium while the user observes that it is ejected on the upper surface of the main body frame, whereby a working operation for taking out the recording medium becomes easy.

In the above-described aspect, the first end side in the first direction may be positioned on the left side when viewed from the operation section side, and the second end side in the first direction may be positioned on the right side when viewed from the operation section.

According to the aspect, since the space exists on the right side, when the apparatus is viewed from the operation section side, workability of the most of users is improved because greater part of users is right-handed user.

In the above-described aspect, a cover body for opening and closing the inside of the main body frame may be provided on the upstream side in the ejection direction of the recording medium in the main body frame.

According to the aspect, the cover body for opening and closing the inside of the main body frame is provided on the same side as that of the operation section. Accordingly, the maintenance and exchange for the image formation section and the like contained in the main body frame as well as the operations for the image scanning device can be made in the same direction, resulting in good workability.

In the above-described aspect, a container for containing the recording media to be conveyed to the image formation section may be provided so as to be extractable towards the upstream side in the ejection direction of the recording media in the main body frame.

According to the aspect, an opening for the drawer from the main body frame of the container containing the recording media is disposed on the same side as that of the operation section, whereby operations for drawing and pushing in the container as well as operations for the image scanning device may be made in the same direction, resulting in good workability.

In the above-described aspect, the first supporting section may contain electric components.

According to the aspect, the electric components such as a power source board, and a control board are disposed in the first supporting section, whereby the space in the first supporting section can be effectively utilized.

As described above, according to the invention, the workability for taking out the recording medium ejected on the upper surface of the main body frame is improved in the image forming apparatus wherein an operation section for operating an image scanning device is provided on the upstream side of the ejection direction of the recording media.

What is claimed is:

1. An image forming apparatus, comprising:

a main body frame;

an image formation section that is contained in the main body frame and forms an image on a recording medium;

an ejection mechanism that ejects the recording medium on which an image has been formed by the image formation section to an ejection section, the ejection section being provided on an upper surface of the main body frame and being provided in a downstream side, in an ejection direction of the recording medium, from a position where the recording medium is ejected from the main body frame by the ejection mechanism, an end side of the ejection section in a downstream side in the ejection direction being defined as a back end side, a direction perpendicular to the ejection direction being defined as a first direction, an end side of the ejection section in the first direction being defined as a first end side, and the other end side of the ejection section in the first direction being defined as a second end side;

a container that contains the recording medium to be conveyed to the image formation section and is extractable toward an opposite direction of the ejection direction;

an image scanning device that is mounted above the ejection section and scans an image of a document; and a supporting section, at the first end side, that supports the image scanning device on the main body frame so as to define a space between the image scanning device and the main body frame wherein the supporting section does not support the image scanning device at the back end side and the second end side, wherein the back end side and a half of the second side along the ejection direction of the image scanning device are unsupported.

2. The image forming apparatus of claim 1, wherein the supporting section comprises a first supporting section provided at the first end side.

3. The image forming apparatus of claim 2, further comprises a second supporting section provided on the main body frame at a location upstream from the ejection section.

* * * * *